US008585002B2

(12) United States Patent
Ho

(10) Patent No.: US 8,585,002 B2
(45) Date of Patent: Nov. 19, 2013

(54) PURSE HANGER

(76) Inventor: Yat Hung Ho, Hong Kong (HK)

( * ) Notice: Subject to any disclaimer, the term of this patent is extended or adjusted under 35 U.S.C. 154(b) by 131 days.

(21) Appl. No.: 13/244,639

(22) Filed: Sep. 25, 2011

(65) Prior Publication Data

US 2012/0248272 A1 Oct. 4, 2012

Related U.S. Application Data

(60) Provisional application No. 61/468,546, filed on Mar. 28, 2011.

(51) Int. Cl.
*F16B 45/00* (2006.01)

(52) U.S. Cl.
USPC ..... 248/304; 248/914

(58) Field of Classification Search
USPC ..... 248/304, 308, 914, 215, 339; 223/120
See application file for complete search history.

(56) References Cited

U.S. PATENT DOCUMENTS

| | | | | |
|---|---|---|---|---|
| 3,425,353 | A * | 2/1969 | Halling | 102/255 |
| 4,210,302 | A * | 7/1980 | Serkez | 248/308 |
| 7,322,554 | B2 * | 1/2008 | Caroselli et al. | 248/304 |
| 7,644,900 | B2 * | 1/2010 | Yap et al. | 248/304 |
| 7,661,644 | B1 * | 2/2010 | Yen | 248/304 |
| 8,061,669 | B2 * | 11/2011 | Yap et al. | 248/304 |
| 2003/0079314 | A1 | 5/2003 | Yeh | |
| 2005/0082319 | A1 * | 4/2005 | Caroselli et al. | 223/120 |
| 2005/0161570 | A1 * | 7/2005 | Bauerly | 248/317 |
| 2006/0108497 | A1 * | 5/2006 | Miranda | 248/690 |
| 2010/0150694 | A1 | 6/2010 | Zhang | |

FOREIGN PATENT DOCUMENTS

| | | |
|---|---|---|
| CN | 2154318 | 1/1994 |
| CN | 101474015 | 7/2009 |
| CN | 201624276 | 11/2010 |
| CN | 201709687 | 1/2011 |

* cited by examiner

*Primary Examiner* — Steven Marsh
(74) *Attorney, Agent, or Firm* — Kam W. Law; Squire Sanders

(57) ABSTRACT

Disclosed herein are purse hanger comprising a housing (1) having a bottom surface (14) and a locking cavity (20), wherein the bottom surface being adapted to rest upon and frictionally engage a flat surface; a first link (3) and a second link (2) pivotally linked to each other; a connection pin (10) extending from a terminal end of the first link (3), wherein the connection pin (10) is rotatably attached to the housing (1) around an axis (15); a locking pin (5) extending from a terminal end of the second link (2); and a frictional element (4) in the housing (1); wherein the frictional element (4) is adapted to frictionally engage with the locking pin (5). In some embodiments, the axis (15) passes through the housing at an angle to the bottom surface (14).

18 Claims, 7 Drawing Sheets a b

2a

2b

7a

7b

PURSE HANGER

FIELD OF THE INVENTION

This invention relates to purse hangers for hanging purses or handbags from a flat surface, more particularly, purse hangers comprising a housing, a first link, a second link pivotally linked to the first link, a connection pin extending from a terminal end of the first link, a locking pin extending from a terminal end of the second link, and a frictional element in the housing, wherein the frictional element is adapted to frictionally engage with the locking pin.

BACKGROUND OF THE INVENTION

When people go to a restaurant, a bar, a cafe or the like, it has been always a problem for them to find a place to put their purses, handbags, briefcases, backpacks and the like. Some people may just hang their purses or handbags on the back of their chairs. However, there may be security problem because someone may slip off their purses or handbags behind them. Other people may just put their purses or handbags on the floor under their feet. But the purses or handbags may restrict the movement of their feet and there is a sanitary problem because the floor in a restaurant, bar or cafe is generally dirty and their feet may accidentally step on them.

Therefore, there is always a need for a devise to keep purses, handbags, briefcases, or backpacks close, secure, clean and off the floor, preferably a devise with style. More particularly, there is a need for decorative hangers for hanging purses, handbags, briefcases, or backpacks from a flat surface.

SUMMARY OF THE INVENTION

In one aspect, provided herein are purse hangers comprising:

a) a housing having a bottom surface and a locking cavity, wherein the bottom surface being adapted to rest upon and frictionally engage a flat surface;
b) a first link and a second link pivotally linked to each other;
c) a connection pin extending from a terminal end of the first link, wherein the connection pin is rotatably attached to the housing around an axis;
d) a locking pin extending from a terminal end of the second link; and
e) a frictional element in the housing, wherein the frictional element is adapted to frictionally engage with the locking pin.

In certain embodiments, the axis passes through the housing at an angle to the bottom surface. In some embodiments, the angle between the axis and the bottom surface is at least +1 degree, at least +2 degree, at least +3 degree, at least +5 degree, or at least +10 degree. In certain embodiments, the angle is at least −1 degree, at least −2 degree, at least −3 degree, at least −5 degree, or at least −10 degree. In certain embodiments, the part of the housing attached to the connection pin is thicker than other parts of the housing.

In some embodiments, the housing further comprises a ball and a spring, wherein the spring urges the ball against the connection pin. In certain embodiments, the connection pin further comprises a depression for engaging with the ball. In some embodiments, the ball comprises a metal or metal alloy.

In some embodiments, the frictional element comprises a polymer or a polymer composition comprising a polymer. In certain embodiments, the frictional element comprises a natural rubber, a synthetic rubber or a combination thereof In certain embodiments, the second link is adapted to move between a first position for hanging the purse and a second position for interlocking with the housing. In some embodiments, when the second link is in the second position, the first link and the second link together form a ring configuration extending away from the housing. In certain embodiments, the ring configuration is substantially circular, semi-circular, oval, triangular, square, rectangular, pentagonal, hexagonal, heptagonal, octagonal, nonagonal or decagonal in shape.

In some embodiments, the locking pin further comprises a locking element near a terminal end of the locking pin, and wherein the locking cavity comprises a groove being adapted to interlock with the locking element. In certain embodiments, the locking pin generally corresponds to the shape of the locking cavity.

In certain embodiments, the first link rotatably moves between two terminal positions separated by an angle. In some embodiments, the angle between the two terminal positions is about 90 degree, about 180 degree, about 270 degree or about 360 degree.

In some embodiments, each of the first link and the second link independently comprises a metal or metal alloy. In certain embodiments, the housing comprises a metal or metal alloy.

In certain embodiments, the purse hanger disclosed herein further comprises a decorative element mounted on a surface of the housing opposite to the bottom surface, wherein the decorative element comprises one or more precious metals, one or more precious gems or stones, one or more artificial gemstones, one or more plastic ornaments, or a combination thereof In some embodiments, the purse hanger disclosed herein further comprises a third link between the first link and the second link, wherein the links are pivotally linked together. In certain embodiments, the purse hanger disclosed herein further comprises a fourth link pivotally linked to the first link and the third link.

In certain embodiments, the purse hanger disclosed herein further comprises a frictional layer attached to the bottom surface.

DETAILED DESCRIPTION OF THE INVENTION

Figure 1:
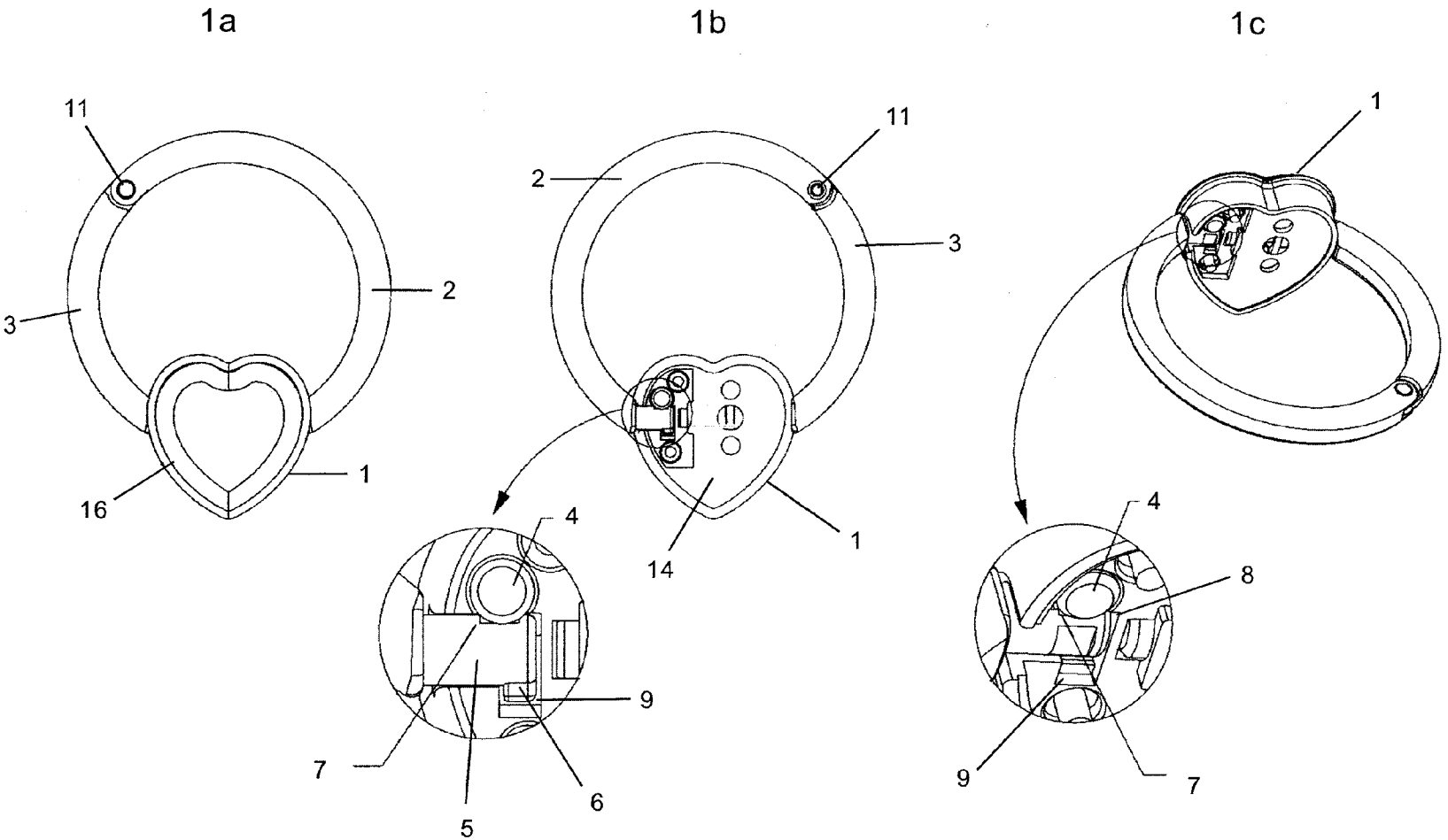
FIG. 1*a* depicts a front view of a first embodiment of the purse hanger disclosed herein where the second link (2) is in a second position for interlocking with the housing.
FIG. 1*b* depicts a back view of the first embodiment of the purse hanger disclosed herein where the second link (2) is in the second position for interlocking with the housing.
FIG. 1*c* depicts an elevated view of the first embodiment of the purse hanger disclosed herein where the second link (2) is in the second position for interlocking with the housing.
Figure 2:
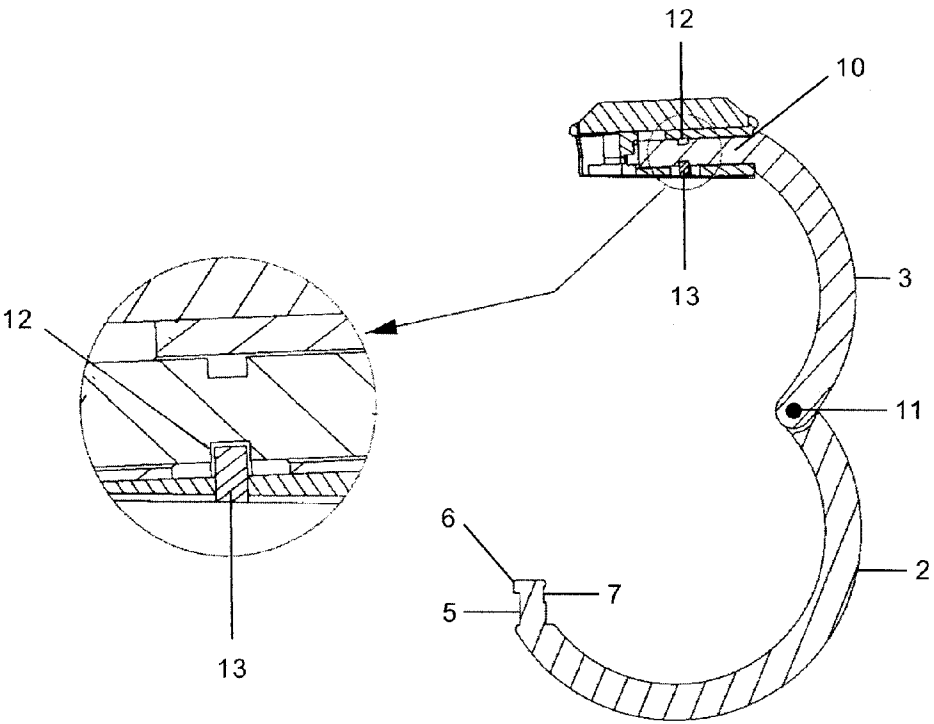
FIG. 2*a* depicts a cross-section of the first embodiment of the purse hanger disclosed herein where the second link (2) is in a first position for hanging purses and handbags.
FIG. 2*b* depicts an elevated view of the first embodiment of the purse hanger disclosed herein where the second link (2) is in the first position for hanging purses and handbags.
Figure 2:
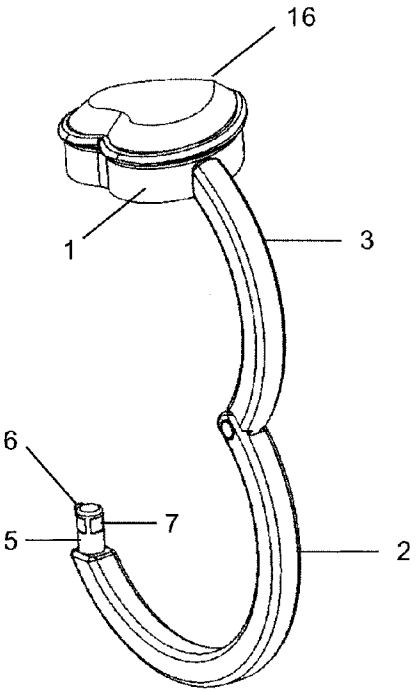
Figure 3:
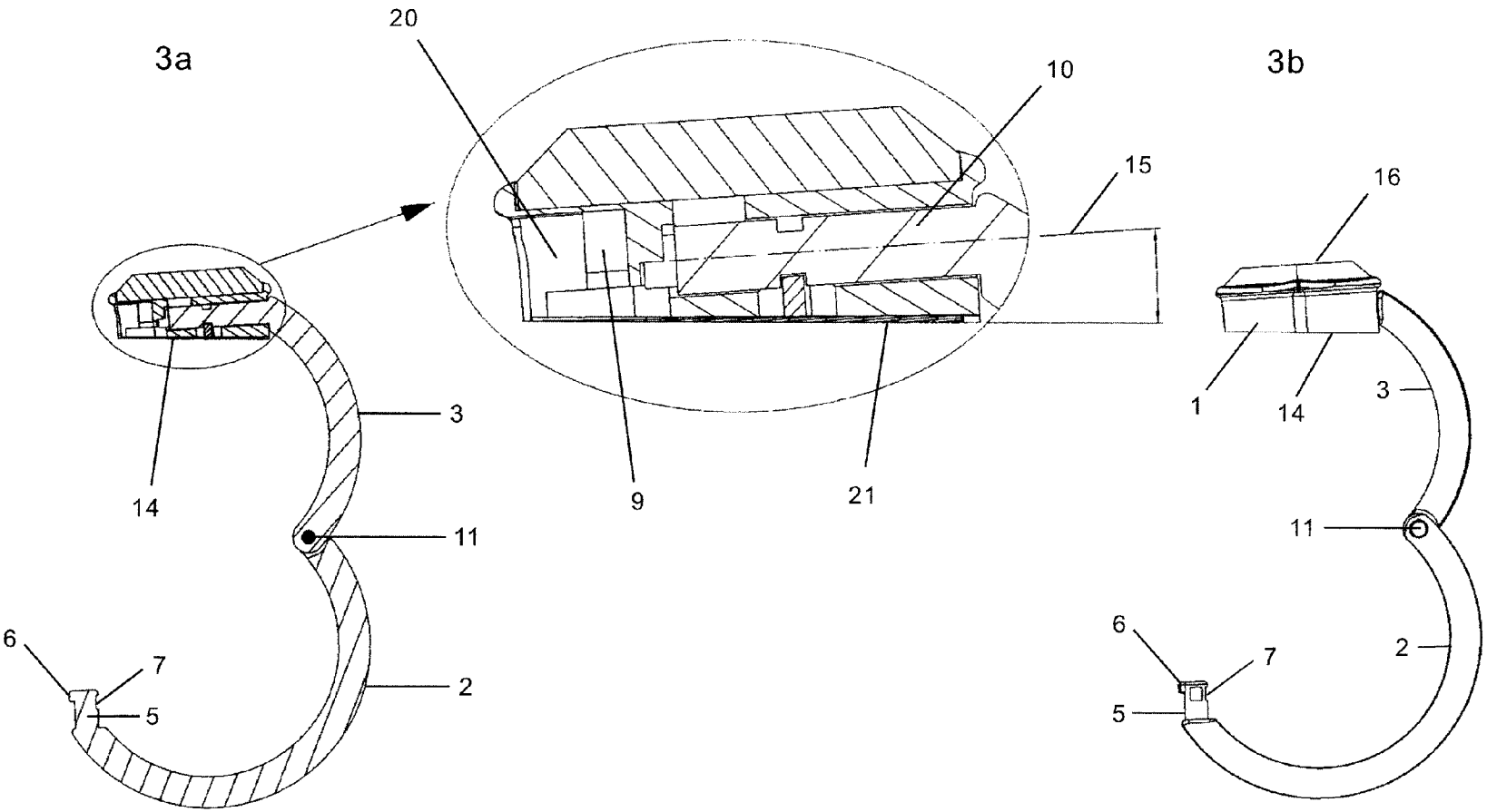
FIG. 3*a* depicts a cross-section of the first embodiment of the purse hanger disclosed herein where the second link (2) is in a first position for hanging purses and handbags.
FIG. 3*b* depicts a side view of the first embodiment of the purse hanger disclosed herein where the second link (2) is in the first position for hanging purses and handbags.
Figure 4:
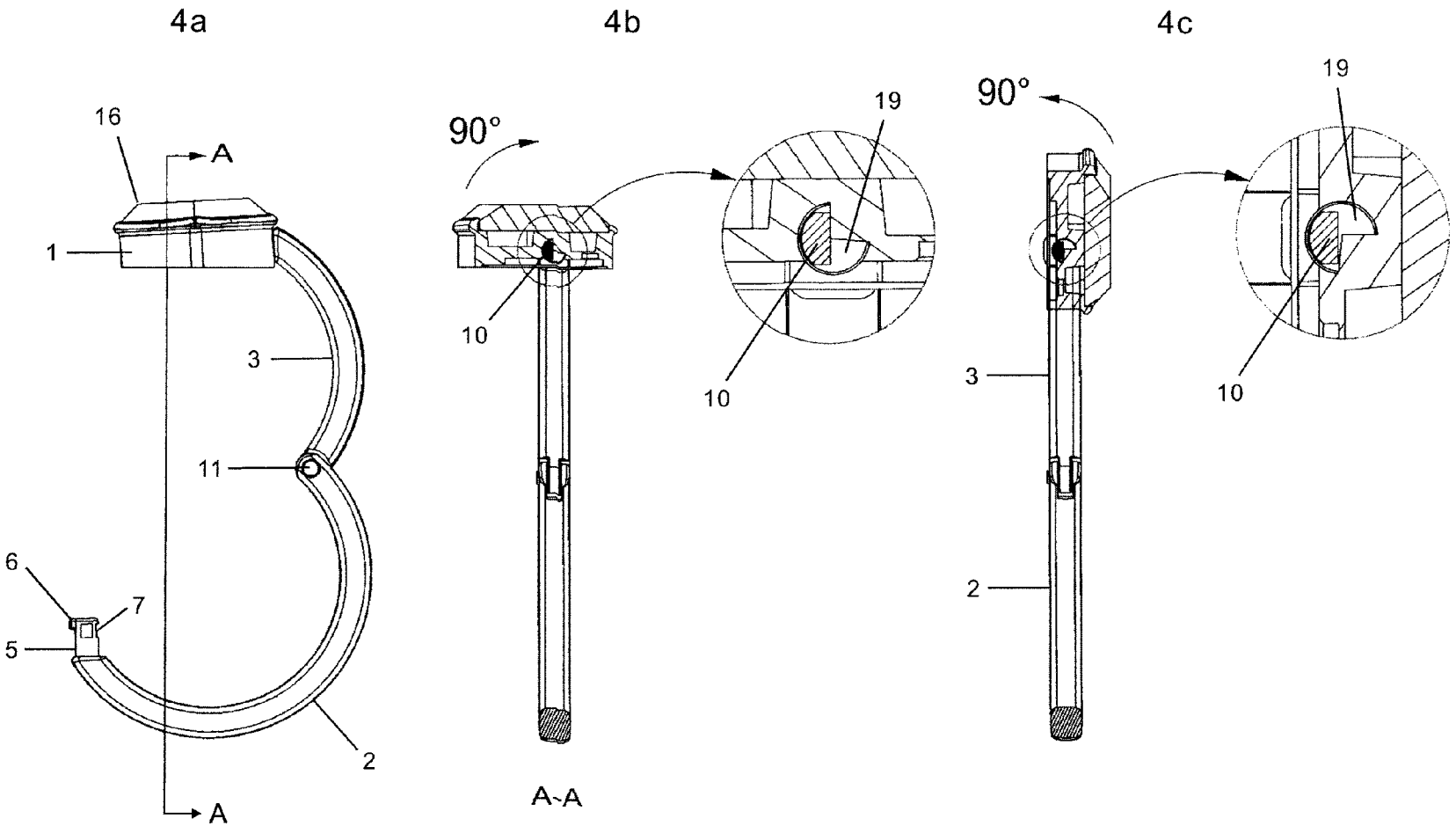
FIG. 4*a* depicts a side view of a second embodiment of the purse hanger disclosed herein where the second link (2) is in a first position for hanging purses and handbags.
FIG. 4*b* depicts a cross-section of the second embodiment of the purse hanger disclosed herein where the second link (2) is in the first position for hanging purses and handbags, and where the first link (3) is in a first terminal position.
FIG. 4*c* depicts a cross-section of the second embodiment of the purse hanger disclosed herein where the second link (2) is in the first position for hanging purses and handbags, and where the first link (3) is in a second terminal position where the angle between the first terminal position and the second terminal position is 90 degree.
Figure 5:
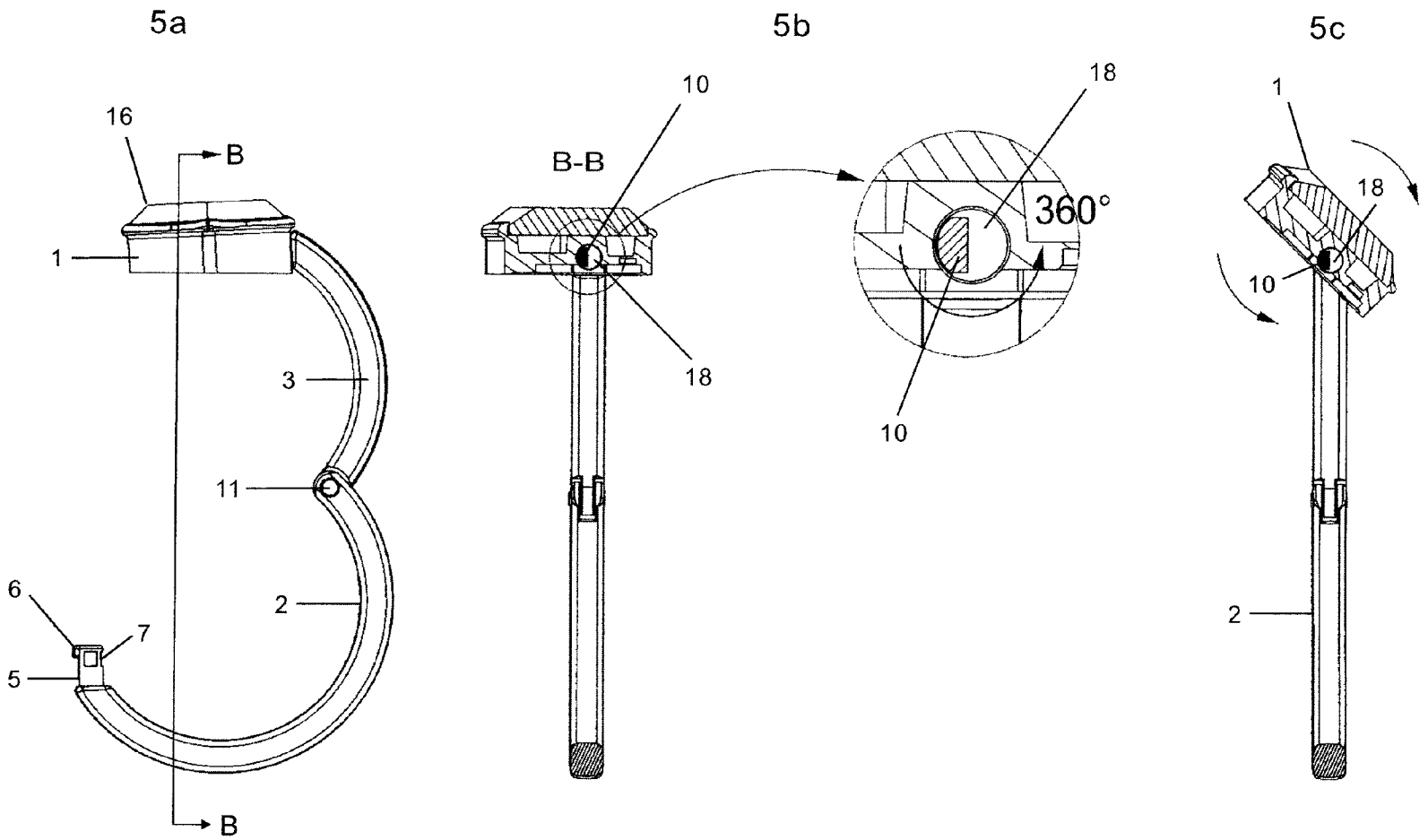
FIG. 5*a* depicts an elevated view of a third embodiment of the purse hanger disclosed herein where the second link (2) is in a first position for hanging purses and handbags.
FIG. 5*b* depicts a cross-section of the third embodiment of the purse hanger disclosed herein where the second link (2) is in the first position for hanging purses and handbags, and where the first link (3) is in a first terminal position.
FIG. 5*c* depicts a cross-section of the third embodiment of the purse hanger disclosed herein where the second link (2) is in the first position for hanging purses and handbags, and the first link (3) is in a second terminal position where the angle between the first terminal position and the second terminal position is 360 degree.
Figure 6:
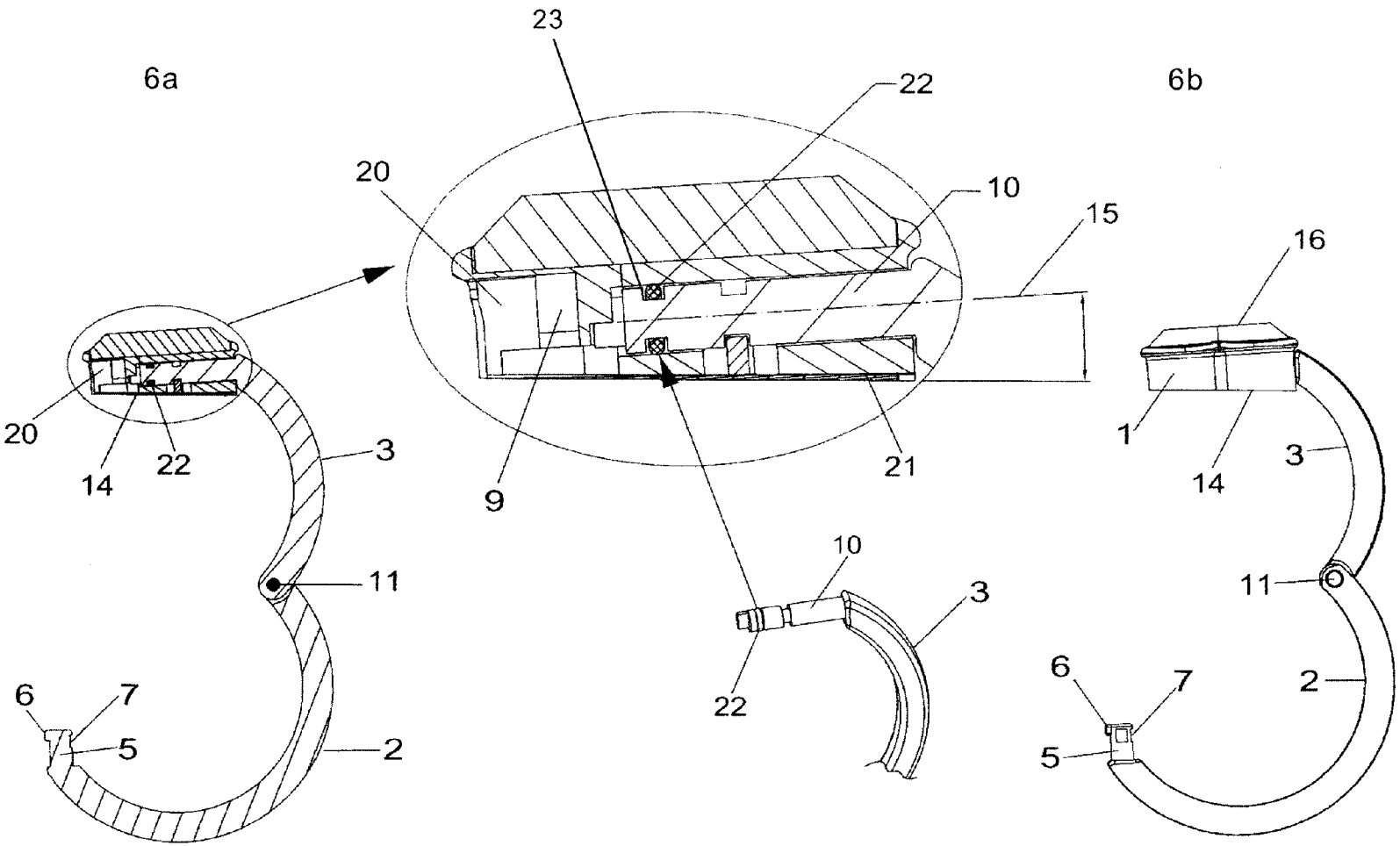
FIG. 6*a* depicts a cross-section of a fourth embodiment of the purse hanger disclosed herein where the second link (2) is in a first position for hanging purses and handbags.
FIG. 6*b* depicts a side view of the fourth embodiment of the purse hanger disclosed herein where the second link (2) is in the first position for hanging purses and handbags.

Provided herein are purse hanger comprising:

a) a housing having a bottom surface and a locking cavity, wherein the bottom surface being adapted to rest upon and frictionally engage a flat surface;

b) a first link and a second link pivotally linked to each other;

c) a connection pin extending from a terminal end of the first link, wherein the connection pin is rotatably attached to the housing around an axis;

d) a locking pin extending from a terminal end of the second link; and e) a frictional element in the housing, wherein the frictional element is adapted to frictionally engage with the locking pin.

Also provided herein are purse hanger comprising:

a) a housing having a bottom surface and a locking cavity, wherein the bottom surface being adapted to rest upon and frictionally engage a flat surface;

b) a first link and a second link pivotally linked to each other;

c) a connection pin extending from a terminal end of the first link, wherein the connection pin is rotatably attached to the housing around an axis, and wherein the axis passes through the housing at an angle to the bottom surface;

d) a locking pin extending from a terminal end of the second link; and e) a frictional element in the housing, wherein the frictional element is adapted to frictionally engage with the locking pin.

In certain embodiments, the angle between the axis and the bottom surface is at least +1 degree, at least +2 degree, at least +3 degree, at least +5 degree, at least +10 degree, at least +15 degree, at least +20 degree or at least +30 degree. In some embodiments, the angle is at least −1 degree, at least −2 degree, at least −3 degree, at least −5 degree, at least −10 degree, at least −15 degree, at least −20 degree or at least −30 degree. The desired angle depends on the geometry shape of the edge of the flat surface. In certain embodiments, the angle can be used to adjust the thickness across the housing so that the bottom surface can engage better with the flat surface. In some embodiments, the part of the housing next to the terminal end of the first link is thicker than other parts of the housing.

In certain embodiments, the part of the housing next to the terminal end of the first link is thicker than other parts of the housing. In some embodiment, the part of the housing next to the terminal end of the first link is at least 1%, at least 2.5%, at least 5%, at least 10%, at least 15%, at least 25%, at least 30%, at least 25%, at least 40%, at least 45%, at least 50%, at least 75%, or at least 100%, thicker than other parts of the housing. In other embodiment, the part of the housing next to the terminal end of the first link is at least 1%, at least 2.5%, at least 5%, at least 10%, at least 15%, at least 25%, at least 30%, at least 25%, at least 40%, at least 45%, or at least 50% thinner than other parts of the housing.

In certain embodiments, the housing further comprises an engaging element for engaging with the connection pin so as to provide a resistance to the rotation of the connection pin. Any engaging element that can provide a resistance to the free rotation of the connection pin can be used herein. In some embodiments, the engaging element comprises a ball and a spring, wherein the spring urges the ball against the connection pin. In certain embodiments, the connection pin further comprises a depression for engaging with the ball to provide a resistance to the rotation of the connection pin. In some embodiments, the ball comprises a metal or metal alloy. In certain embodiments, the metal is stainless steel, carbon steel, chrome steel, tool steel, Nitinol 60, ceramic (e.g., silicon nitride), aluminum, tungsten carbide, platinum, brass, gold, titanium, copper, bronze, chrome, tungsten carbide, monel, kmonel, silver, niobium, glass, plastic or a combination thereof In some embodiments, the engaging element comprises a rubber ring. The rubber ring may frictionally engage with a portion of the housing to provide a resistance to the rotation of the connection pin. In certain embodiments, the rubber ring sits in a circular groove in the connection pin.

In certain embodiments, the second link is adapted to move between a first position for hanging the purse and a second position for interlocking with the housing. In some embodiments, when the second link is in the second position, the first link and the second link together form a ring configuration extending away from the housing. In certain embodiments, the ring configuration is substantially circular, semi-circular, oval, triangular, square, rectangular, pentagonal, hexagonal, heptagonal, octagonal, nonagonal or decagonal in shape.

In certain embodiments, the ring configuration rotatably moves between two terminal positions separated by an angle.

In some embodiments, the angle between the two terminal positions is about 90 degree, about 180 degree, about 270 degree or about 360 degree. In other embodiments, the angle between the two terminal positions is from about 30 degree to about 180 degree, from about 45 degree to about 135 degree, or from about 60 degree to about 120 degree.

In some embodiments, the locking pin further comprises a locking element near a terminal end of the locking pin, and wherein the locking cavity comprises a groove being adapted to interlock with the locking element. In certain embodiments, the locking pin generally corresponds to the shape of the locking cavity.

In certain embodiments, the first link rotatably moves between two terminal positions separated by an angle. In some embodiments, the angle between the two terminal positions is about 90 degree, about 180 degree, about 270 degree or about 360 degree. In other embodiments, the angle between the two terminal positions is from about 30 degree to about 180 degree, from about 45 degree to about 135 degree, or from about 60 degree to about 120 degree.

In some embodiments, each of the first link and the second link independently comprises a metal or metal alloy. In certain embodiments, the housing comprises a metal or metal alloy. In some embodiments, each of the links or housing disclosed herein independently comprises a metal or metal alloy. Any suitable metal or metal alloy known for making fashion ornaments or jewelry can be used. Some non-limiting examples of suitable metals include zinc, copper, tin, lead, aluminum, titanium, molybdenum, vanadium, tungsten or a combination thereof. Some non-limiting examples of suitable metal alloys include alloys of at least two of the metal selected from zinc, copper, tin, lead, aluminum, titanium, molybdenum, vanadium, and tungsten. In some embodiments, the metal alloys are selected from alloys of copper and zinc, aluminum alloys, tungsten alloys, cobalt-copper alloys and combinations thereof In certain embodiments, the purse hanger further comprises a decorative element mounted on a surface of the housing. In some embodiments, the decorative elements disclosed herein comprises one or more precious metals, one or more precious gems or stones, one or more artificial gemstones, one or more plastic ornaments, or a combination thereof. Some non-limiting examples of suitable metals include gold, silver, platinum, and combinations thereof. Some non-limiting examples of suitable precious gems or stones include diamond, ruby, sapphire, pearl, opal, beryls such as emerald (green), aquamarine (blue), red beryl (red), goshenite (colorless), heliodor (yellow), and morganite (pink), peridot, cat's eye, andalusite, axinite, cassiterite, clinohumite, amber, turquoise, hematite, chrysocolla, tiger's eye, quartz, tourmaline, carnelian, pyrite, sugilite, malachite, rose quartz, snowflake obsidian, ruby, moss agate, amethyst, blue lace agate, lapis lazuli and the like.

In some embodiments, the purse hanger disclosed herein further comprises a third link between the first link and the second link, wherein the links are pivotally linked together. In certain embodiments, the purse hanger disclosed herein further comprises a fourth link pivotally linked to the first link and the third link.

In certain embodiments, the purse hanger disclosed herein further comprises a frictional layer attached to the bottom surface. Any material that can frictionally engage a flat surface can be used herein for the frictional layer. In some embodiments, the frictional layer comprises a polymer a polymer or a polymer composition, a woven fibric, a non-woven fibric or a glass fibric.

The frictional element disclosed herein can be in any shape or form suitable for engaging with the locking pin. In some embodiments, the frictional element is in the shape of a cylinder, oval prism, triangular prism, square prism, rectangular prism, pentagonal prism, hexagonal prism, heptagonal prism, octagonal prism, nonagonal prism, or decagonal prism. In other embodiments, the frictional element is solid. In further embodiments, the frictional element is hallow.

In some embodiments, each of the frictional element or the frictional layer independently comprises a polymer or a polymer composition comprising a polymer. In certain embodiments, each of the frictional element or the frictional layer independently comprises a natural rubber, a synthetic rubber or a combination thereof.

Any polymer such as plastic polymers or elastomers (e.g., natural rubber or synthetic rubbers) known in the art can be used herein. Some non-limiting examples of suitable polymers include natural rubber, synthetic rubbers, neoprene, nylon, PVC, polystyrene, polyethylene, polypropylene, polyacrylonitrile, PVB, silicone and the like. Some non-limiting examples of suitable elastomers include natural rubber (NR), synthetic rubbers, synthetic polyisoprene (IR), butyl rubber (copolymer of isobutylene and isoprene, IIR), halogenated butyl rubbers (chloro butyl rubber: CIIR; bromo butyl rubber: BIIR), polybutadiene (BR), styrene-butadiene Rubber (copolymer of polystyrene and polybutadiene, SBR), nitrile rubber (copolymer of polybutadiene and acrylonitrile, NBR), hydrogenated nitrile rubbers (HNBR), chloroprene rubber (CR) such as polychloroprene, Neoprene and Baypren, EPM (ethylene propylene rubber, a copolymer of ethylene and propylene), EPDM rubber (ethylene propylene diene rubber, a terpolymer of ethylene, propylene and a diene-component), epichlorohydrin rubber (ECO), polyacrylic rubber (ACM, ABR), silicone rubber (SI, Q, VMQ), fluorosilicone rubber (FVMQ), fluoroelastomers (FKM, and FEPM) such as Viton, Tecnoflon, Fluorel, Aflas and Dai-El, perfluoroelastomers (FFKM) such as Tecnoflon PFR, Kalrez, Chemraz, and Perlast, polyether block amides (PEBA), chlorosulfonated polyethylene (CSM) such as Hypalon, Ethylene-vinyl acetate (EVA), thermoplastic elastomers (TPE), such as Elastron, thermoplastic vulcanizates (TPV) such as Santoprene TPV, thermoplastic polyurethane (TPU), thermoplastic olefins (TPO), the proteins resilin and elastin, polysulfide rubber and combinations thereof In some embodiments, each of the frictional element or the frictional layer independently comprises a polymer composition. In certain embodiments, the polymer composition comprises a polymer and at least one additive. Any additive that can improve and/or control the processibility, appearance, physical, chemical, and/or mechanical properties of the polymer compositions can be used herein. Non-limiting examples of suitable additives include colorants or pigments, UV stabilizers, plasticizers, antioxidants, fillers, lubricants, antifogging agents, flow aids, coupling agents, cross-linking agents, nucleating agents, surfactants, slip agents, anti-blocking agents, solvents, flame retardants, antistatic agents, and combinations thereof. The total amount of the additives can range from about greater than 0 to about 80 wt. %, from about 0.001 wt. % to about 70 wt. %, from about 0.01 wt. % to about 60 wt. %, from about 0.1 wt. % to about 50 wt. %, from about 1 wt. % to about 40 wt. %, or from about 10 wt. % to about 50 wt. % of the total weight of the polymer composition. Some polymer additives have been described in Zweifel Hans et al., "*Plastics Additives Handbook*," Hanser Gardner Publications, Cincinnati, Ohio, 5th edition (2001), which is incorporated herein by reference in its entirety.

Optionally, the polymer compositions disclosed herein comprise a colorant or pigment that can change the look of the polymer compositions to human eyes. Any colorant or pigment known to a person of ordinary skill in the art may be added to the polymer compositions disclosed herein. Non-limiting examples of suitable colorants or pigments include inorganic pigments such as metal oxides such as iron oxide, zinc oxide, and titanium dioxide, mixed metal oxides, carbon black, organic pigments such as anthraquinones, anthanthrones, azo and monoazo compounds, arylamides, benzimidazolones, BONA lakes, diketopyrrolo-pyrroles, dioxazines, disazo compounds, diarylide compounds, flavanthrones, indanthrones, isoindolinones, isoindolines, metal complexes, monoazo salts, naphthols, b-naphthols, naphthol AS, naphthol lakes, perylenes, perinones, phthalocyanines, pyranthrones, quinacridones, and quinophthalones, and combinations thereof. Where used, the amount of the colorant or pigment in the polymer composition can be from about greater than 0 to about 10 wt %, from about 0.1 to about 5 wt %, or from about 0.25 to about 2 wt % of the total weight of the polymer composition. Some colorants have been described in Zweifel Hans et al., "*Plastics Additives Handbook*," Hanser Gardner Publications, Cincinnati, Ohio, 5th edition, Chapter 15, pages 813-882 (2001), which is incorporated herein by reference.

Optionally, the polymer compositions disclosed herein can comprise a filler which can be used to adjust, inter alia, volume, weight, costs, and/or technical performance. Any filler known to a person of ordinary skill in the art may be added to the polymer compositions disclosed herein. Non-limiting examples of suitable fillers include talc, calcium carbonate, chalk, calcium sulfate, clay, kaolin, silica, glass, fumed silica, mica, wollastonite, feldspar, aluminum silicate, calcium silicate, alumina, hydrated alumina such as alumina trihydrate, glass microsphere, ceramic microsphere, thermoplastic microsphere, barite, wood flour, glass fibers, carbon fibers, marble dust, cement dust, magnesium oxide, magnesium hydroxide, antimony oxide, zinc oxide, barium sulfate, titanium dioxide, titanates and combinations thereof. In some embodiments, the filler is barium sulfate, talc, calcium carbonate, silica, glass, glass fiber, alumina, titanium dioxide, or a mixture thereof. In other embodiments, the filler is talc, calcium carbonate, barium sulfate, glass fiber or a mixture thereof. Where used, the amount of the filler in the polymer composition can be from about greater than 0 to about 80 wt %, from about 0.1 to about 60 wt %, from about 0.5 to about 40 wt %, from about 1 to about 30 wt %, or from about 10 to about 40 wt % of the total weight of the polymer composition. Some fillers have been disclosed in U.S. Pat. No. 6,103,803 and Zweifel Hans et al., "*Plastics Additives Handbook*," Hanser Gardner Publications, Cincinnati, Ohio, 5th edition, Chapter 17, pages 901-948 (2001), both of which are incorporated herein by reference.

Optionally, the polymer compositions disclosed herein comprise an UV stabilizer that may prevent or reduce the degradation of the polymer compositions by UV radiations. Any UV stabilizer known to a person of ordinary skill in the art may be added to the polymer compositions disclosed herein. Non-limiting examples of suitable UV stabilizers include benzophenones, benzotriazoles, aryl esters, oxanilides, acrylic esters, formamidines, carbon black, hindered amines, nickel quenchers, hindered amines, phenolic antioxidants, metallic salts, zinc compounds and combinations thereof. Where used, the amount of the UV stabilizer in the polymer composition can be from about greater than 0 to about 5 wt %, from about 0.01 to about 3 wt %, from about 0.1 to about 2 wt %, or from about 0.1 to about 1 wt % of the total weight of the polymer composition. Some UV stabilizers have been described in Zweifel Hans et al., "*Plastics Additives Handbook*," Hanser Gardner Publications, Cincinnati, Ohio, 5th edition, Chapter 2, pages 141-426 (2001), which is incorporated herein by reference.

Optionally, the polymer compositions disclosed herein comprise a plasticizer. In general, a plasticizer is a chemical that can increase the flexibility and lower the glass transition temperature of polymers. Any plasticizer known to a person of ordinary skill in the art may be added to the polymer compositions disclosed herein. Non-limiting examples of plasticizers include mineral oils, abietates, adipates, alkyl sulfonates, azelates, benzoates, chlorinated paraffins, citrates, epoxides, glycol ethers and their esters, glutarates, hydrocarbon oils, isobutyrates, oleates, pentaerythritol derivatives, phosphates, phthalates, esters, polybutenes, ricinoleates, sebacates, sulfonamides, tri- and pyromellitates, biphenyl derivatives, stearates, difuran diesters, fluorine-containing plasticizers, hydroxybenzoic acid esters, isocyanate adducts, multi-ring aromatic compounds, natural product derivatives, nitriles, siloxane-based plasticizers, tar-based products, thioeters and combinations thereof. Where used, the amount of the plasticizer in the polymer composition can be from greater than 0 to about 15 wt %, from about 0.5 to about 10 wt %, or from about 1 to about 5 wt % of the total weight of the polymer composition. Some plasticizers have been described in George Wypych, "*Handbook of Plasticizers*," ChemTec Publishing, Toronto-Scarborough, Ontario (2004), which is incorporated herein by reference.

Optionally, the polymer compositions disclosed herein comprise an antioxidant that can prevent the oxidation of polymer components and organic additives in the polymer compositions. Any antioxidant known to a person of ordinary skill in the art may be added to the polymer compositions disclosed herein. Non-limiting examples of suitable antioxidants include aromatic or hindered amines such as alkyl diphenylamines, phenyl-α-naphthylamine, alkyl or aralkyl substituted phenyl-α-naphthylamine, alkylated p-phenylene diamines, tetramethyl-diaminodiphenylamine and the like; phenols such as 2,6-di-t-butyl-4-methylphenol; 1,3,5-trimethyl-2,4,6-tris(3',5'-di-t-butyl-4'-hydroxybenzyl)benzene; tetrakis[(methylene(3,5-di-t-butyl-4-hydroxyhydrocinnamate)]methane (e.g., IRGANOX™ 1010, from Ciba Geigy, N.Y.); acryloyl modified phenols; octadecyl-3,5-di-t-butyl-4-hydroxycinnamate (e.g., IRGANOX™ 1076, commercially available from Ciba Geigy); phosphites and phosphonites; hydroxylamines; benzofuranone derivatives; and combinations thereof. Where used, the amount of the antioxidant in the polymer composition can be from about greater than 0 to about 5 wt %, from about 0.0001 to about 2.5 wt %, from about 0.001 to about 1 wt %, or from about 0.001 to about 0.5 wt % of the total weight of the polymer composition. Some antioxidants have been described in Zweifel Hans et al., "*Plastics Additives Handbook*," Hanser Gardner Publications, Cincinnati, Ohio, 5th edition, Chapter 1, pages 1-140 (2001), which is incorporated herein by reference.

Optionally, the polymer compositions disclosed herein comprise a lubricant. In general, the lubricant can be used, inter alia, to modify the rheology of the molten polymer compositions, to improve the surface finish of molded articles, and/or to facilitate the dispersion of fillers or pigments. Any lubricant known to a person of ordinary skill in the art may be added to the polymer compositions disclosed herein. Non-limiting examples of suitable lubricants include fatty alcohols and their dicarboxylic acid esters, fatty acid esters of short-chain alcohols, fatty acids, fatty acid amides, metal soaps, oligomeric fatty acid esters, fatty acid esters of long-chain alcohols, montan waxes, polyethylene waxes, polypropylene waxes, natural and synthetic paraffin waxes, fluoropolymers and combinations thereof. Where used, the amount of the lubricant in the polymer composition can be from about greater than 0 to about 5 wt %, from about 0.1 to about 4 wt %, or from about 0.1 to about 3 wt % of the total weight of the polymer composition. Some suitable lubricants have been disclosed in Zweifel Hans et al., "*Plastics Additives Handbook*," Hanser Gardner Publications, Cincinnati, Ohio, 5th edition, Chapter 5, pages 511-552 (2001), both of which are incorporated herein by reference.

Optionally, the polymer compositions disclosed herein comprise an antistatic agent. Generally, the antistatic agent can increase the conductivity of the polymer compositions and to prevent static charge accumulation. Any antistatic agent known to a person of ordinary skill in the art may be added to the polymer compositions disclosed herein. Non-limiting examples of suitable antistatic agents include conductive fillers (e.g., carbon black, metal particles and other conductive particles), fatty acid esters (e.g., glycerol monostearate), ethoxylated alkylamines, diethanolamides, ethoxylated alcohols, alkylsulfonates, alkylphosphates, quaternary ammonium salts, alkylbetaines and combinations thereof. Where used, the amount of the antistatic agent in the polymer composition can be from about greater than 0 to about 5 wt %, from about 0.01 to about 3 wt %, or from about 0.1 to about 2 wt % of the total weight of the polymer composition. Some suitable antistatic agents have been disclosed in Zweifel Hans et al., "*Plastics Additives Handbook*," Hanser Gardner Publications, Cincinnati, Ohio, 5th edition, Chapter 10, pages 627-646 (2001), both of which are incorporated herein by reference.

Optionally, the polymer compositions disclosed herein comprise a slip agent. In other embodiments, the polymer compositions disclosed herein do not comprise a slip agent. Slip is the sliding of film surfaces over each other or over some other substrates. The slip performance of films can be measured by ASTM D 1894, *Static and Kinetic Coefficients of Friction of Plastic Film and Sheeting*, which is incorporated herein by reference. In general, the slip agent can convey slip properties by modifying the surface properties of films; and reducing the friction between layers of the films and between the films and other surfaces with which they come into contact.

Any slip agent known to a person of ordinary skill in the art may be added to the polymer compositions disclosed herein. Non-limiting examples of the slip agents include primary amides having about 12 to about 40 carbon atoms (e.g., erucamide, oleamide, stearamide and behenamide); secondary amides having about 18 to about 80 carbon atoms (e.g., stearyl erucamide, behenyl erucamide, methyl erucamide and ethyl erucamide); secondary-bis-amides having about 18 to about 80 carbon atoms (e.g., ethylene-bis-stearamide and ethylene-bis-oleamide); and combinations thereof.

In some embodiments, the slip agent is a primary amide with a saturated aliphatic group having between 18 and about 40 carbon atoms (e.g., stearamide and behenamide). In other embodiments, the slip agent is a primary amide with an unsaturated aliphatic group containing at least one carbon-carbon double bond and between 18 and about 40 carbon atoms (e.g., erucamide and oleamide). In further embodiments, the slip agent is a primary amide having at least 20 carbon atoms. In further embodiments, the slip agent is erucamide, oleamide, stearamide, behenamide, ethylene-bis-stearamide, ethylene-bis-oleamide, stearyl erucamide, behenyl erucamide or a combination thereof. In a particular embodiment, the slip agent is erucamide. In further embodiments, the slip agent is commercially available having a trade name such as ATMER™ SA from Uniqema, Everberg, Belgium; ARMOSLIP® from Akzo Nobel Polymer Chemicals, Chicago, Ill.; KEMAMIDE® from Witco, Greenwich, Conn.; and CRODAMIDE® from Croda, Edison, N.J. Where used, the amount of the slip agent in the polymer composition can be from about greater than 0 to about 3 wt %, from about 0.0001 to about 2 wt %, from about 0.001 to about 1 wt %, from about 0.001 to about 0.5 wt % or from about 0.05 to about 0.25 wt % of the total weight of the polymer composition. Some slip agents have been described in Zweifel Hans et al., "*Plastics Additives Handbook*," Hanser Gardner Publications, Cincinnati, Ohio, 5th edition, Chapter 8, pages 601-608 (2001), which is incorporated herein by reference.

Optionally, the polymer compositions disclosed herein comprise an anti-blocking agent. In some embodiments, the polymer compositions disclosed herein do not comprise an anti-blocking agent. The anti-blocking agent can be used to prevent the undesirable adhesion between touching layers of articles made from the polymer compositions, particularly under moderate pressure and heat during storage, manufacture or use. Any anti-blocking agent known to a person of ordinary skill in the art may be added to the polymer compositions disclosed herein. Non-limiting examples of anti-blocking agents include minerals (e.g., clays, chalk, and calcium carbonate), synthetic silica gel (e.g., SYLOBLOC® from Grace Davison, Columbia, Md.), natural silica (e.g., SUPER FLOSS from Celite Corporation, Santa Barbara, Calif.), talc (e.g., OPTIBLOC® from Luzenac, Centennial, Colo.), zeolites (e.g., SIPERNAT® from Degussa, Parsippany, N.J.), aluminosilicates (e.g., SILTON® from Mizusawa Industrial Chemicals, Tokyo, Japan), limestone (e.g., CARBOREX® from Omya, Atlanta, Ga.), spherical polymeric particles (e.g., EPOSTAR®, poly(methyl methacrylate) particles from Nippon Shokubai, Tokyo, Japan and TOSPEARL®, silicone particles from GE Silicones, Wilton, Conn.), waxes, amides (e.g. erucamide, oleamide, stearamide, behenamide, ethylene-bis-stearamide, ethylene-bis-oleamide, stearyl erucamide and other slip agents), molecular sieves, and combinations thereof. The mineral particles can lower blocking by creating a physical gap between articles, while the organic anti-blocking agents can migrate to the surface to limit surface adhesion. Where used, the amount of the anti-blocking agent in the polymer composition can be from about greater than 0 to about 3 wt %, from about 0.0001 to about 2 wt %, from about 0.001 to about 1 wt %, or from about 0.001 to about 0.5 wt % of the total weight of the polymer composition. Some anti-blocking agents have been described in Zweifel Hans et al., "*Plastics Additives Handbook*," Hanser Gardner Publications, Cincinnati, Ohio, 5th edition, Chapter 7, pages 585-600 (2001), which is incorporated herein by reference.

Optionally, the polymer compositions disclosed herein comprise a cross-linking agent that can be used to increase the cross-linking density of the polymer compositions. Any cross-linking agent known to a person of ordinary skill in the art may be added to the polymer compositions disclosed herein. Non-limiting examples of suitable cross-linking agents include organic peroxides (e.g., alkyl peroxides, aryl peroxides, peroxyesters, peroxycarbonates, diacylperoxides, peroxyketals, and cyclic peroxides) and silanes (e.g., vinyltrimethoxysilane, vinyltriethoxysilane, vinyltris(2-methoxyethoxy)silane, vinyltriacetoxysilane, vinylmethyldimethoxysilane, and 3-methacryloyloxypropyltrimethoxysilane). Where used, the amount of the cross-linking agent in the polymer composition can be from about greater than 0 to about 20 wt %, from about 0.1 to about 15 wt %, or from about 1 to about 10 wt % of the total weight of the polymer composition. Some suitable cross-linking agents have been disclosed in Zweifel Hans et al., "*Plastics Additives Handbook*," Hanser Gardner Publications, Cincinnati, Ohio, 5th edition, Chapter 14, pages 725-812 (2001), both of which are incorporated herein by reference.

The cross-linking of the polymer compositions can also be initiated by any radiation means known in the art, including, but not limited to, electron-beam irradiation, beta irradiation, gamma irradiation, corona irradiation, and UV radiation with or without cross-linking catalyst. U.S. patent application Ser. No. 10/086,057 (published as US2002/0132923 A1) and U.S. Pat. No. 6,803,014 disclose electron-beam irradiation methods that can be used in embodiments of the invention.

Crosslinking can be promoted with a crosslinking catalyst, and any catalyst that will provide this function can be used. Suitable catalysts generally include organic bases, carboxylic acids, and organometallic compounds including organic titanates and complexes or carboxylates of lead, cobalt, iron, nickel, zinc and tin. Dibutyltindilaurate, dioctyltinmaleate, dibutyltindiacetate, dibutyltindioctoate, stannous acetate, stannous octoate, lead naphthenate, zinc caprylate, cobalt naphthenate; and the like. Tin carboxylate, especially dibutyltindilaurate and dioctyltinmaleate, are particularly effective for this invention. The catalyst (or mixture of catalysts) is present in a catalytic amount, typically between about 0.015 and about 0.035 phr.

Some embodiments of the purse hangers disclosed herein are shown in FIGS. 1-6. FIG. 1*a* is a front view of a first embodiment of the purse hanger disclosed herein where a second link (2) is in a second position for interlocking with a housing (1). The purse hangers comprises the housing (1), a decorative element (16) mounted on the housing, a first link (3), the second link (2) and a pivot (11) as shown in FIG. 1*a*. The first link (3) and the second link (2) are pivotally linked to each other by the pivot (11).

FIG. 1*b* is a back view of the first embodiment of the purse hanger disclosed herein where the second link (2) is in the second position for interlocking with the housing (1). A locking pin (5) extends from a terminal end of the second link (2). The first embodiment further comprises a frictional element (4) in the housing (1). The frictional element (4) is adapted to frictionally engage with the locking pin (5). In this embodiment, the locking pin (5) further comprises an indentation (7) which engages with the frictional element (4). The locking pin (5) generally corresponds to the shape of a locking cavity (8). The locking pin (5) further comprises a locking element (6) near a terminal end of the locking pin (5), and wherein the locking cavity (8) comprises a groove (9) being adapted to interlock with the locking element (6).

FIG. 1*c* is an elevated view of the first embodiment of the purse hanger disclosed herein where the second link (2) is in the second position for interlocking with the housing (1). The housing (1) is at 90 degree with a ring configuration formed by the first link (3) and the second link (2). In this embodiment, the first link (3) and the second link (2) extend away from the housing to form a ring configuration together. The ring configuration of the first embodiment is generally circular in shape.

FIG. 2*a* is a cross-section of the first embodiment of the purse hanger disclosed herein where the second link (2) is in a first position for hanging purses and handbags. A connection pin (10) extends from a terminal end of the first link (3). The housing further comprises a block (13) which engaged with the hole (12) of the connection pin (10) and the connection pin (10) is rotatably attached to the housing (1) and is not extendable outside the housing (1).

FIG. 2*b* is an elevated view of the first embodiment of the purse hanger disclosed herein where the second link (2) is in the first position for hanging purses and handbags.

FIG. 3*a* is a cross-section of the first embodiment of the purse hanger disclosed herein where the second link (2) is in a first position for hanging purses and handbags. The connection pin (10) extends from the terminal end of the first link (3). The connection pin (10) is rotatably attached to the housing (1) around an axis (15). The axis (15) passes through the housing at an angle to a bottom surface (14). A frictional layer (21) is attached to the bottom surface (14). In this embodiment, the part of the housing (1) next to the terminal end of the first link (3) is thicker than other parts of the housing (1).

FIG. 3*b* is a side view of the first embodiment of the purse hanger disclosed herein where the second link (2) is in the first position for hanging purses and handbags.

FIG. 4*a* is a side view of a second embodiment of the purse hanger disclosed herein where the second link (2) is in the first position for hanging purses and handbags.

FIG. 4*b* is a cross-section of the second embodiment of the purse hanger disclosed herein where the second link (2) is in the first position for hanging purses and handbags and where the first link (3) is in a first terminal position. The housing (1) further comprise of a restriction cavity (19) which restricts the connection pin (10) moving between the first terminal position and a second terminal position wherein the angle between the two terminal positions is about 90 degree.

FIG. 4*c* is a cross-section of the second embodiment of the purse hanger disclosed herein where the second link (2) is in the first position for hanging purses and handbags, and where the first link is in the second terminal position.

FIG. 5*a* is a side view of a third embodiment of the purse hanger disclosed herein where the second link (2) is in a first position for hanging purses and handbags.

FIG. 5*b* is a cross-section of the third embodiment of the purse hanger disclosed herein where the second link (2) is in the first position for hanging purses and handbags and where the first link (3) is in the first terminal position. The housing (1) further comprise of a restriction cavity (18) which restricts the connection pin (10) moving between the first terminal position and a second terminal position wherein the angle between the two terminal positions is about 360 degree.

FIG. 5*c* is a cross-section of the third embodiment of the purse hanger disclosed herein where the second link (2) is in the first position for hanging purses and handbags, and where the first link (3) is in the second terminal position.

FIG. 6*a* is a cross-section of the fourth embodiment of the purse hanger disclosed herein where the second link (2) is in a first position for hanging purses and handbags. The connection pin (10) extends from the terminal end of the first link (3). The connection pin (10) is rotatably attached to the housing (1) around an axis (15). The connection pin (10) comprises a circular groove (23) therein a rubber ring (22) sits. The rubber ring (22) provides a resistance to the free rotation of the connection pin (10). The axis (15) passes through the housing at an angle to a bottom surface (14). A frictional layer (21) is attached to the bottom surface (14). In this embodiment, the part of the housing (1) next to the terminal end of the first link (3) is thicker than other parts of the housing (1).

FIG. 6*b* is a side view of the fourth embodiment of the purse hanger disclosed herein where the second link (2) is in the first position for hanging purses and handbags.

In some embodiments, the restriction cavity can be designed to restrict the angle between the two terminal positions to about 180 degree, about 270 degree, from about 30 degree to about 180 degree, from about 45 degree to about 135 degree, or from about 60 degree to about 120 degree.

Figure 7:
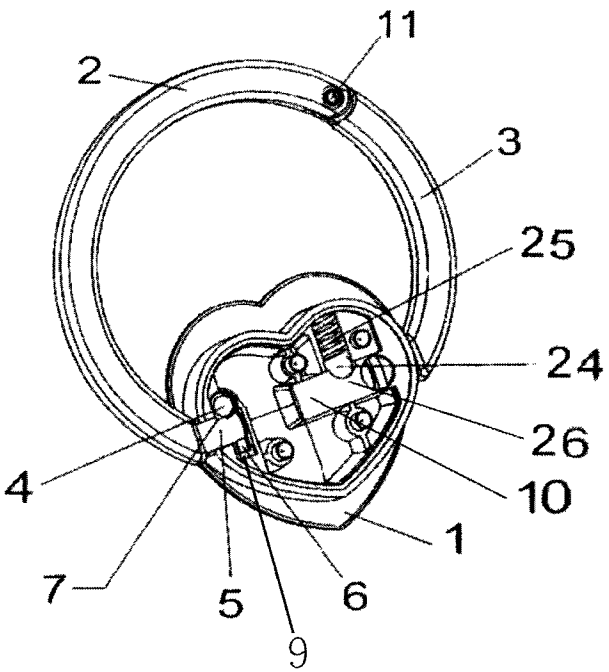
FIG. 7*a* depicts a fifth embodiment of the purse hanger disclosed herein where the second link (2) is in a second position for interlocking with the housing and the first link and the second link together form a ring configuration extending away from the edge of the housing.
FIG. 7*b* depicts the fifth embodiment of the purse hanger disclosed herein where the second link (2) is in the second position and the first link and the second link together form a ring configuration extending away from the bottom of the housing.
Figure 7:
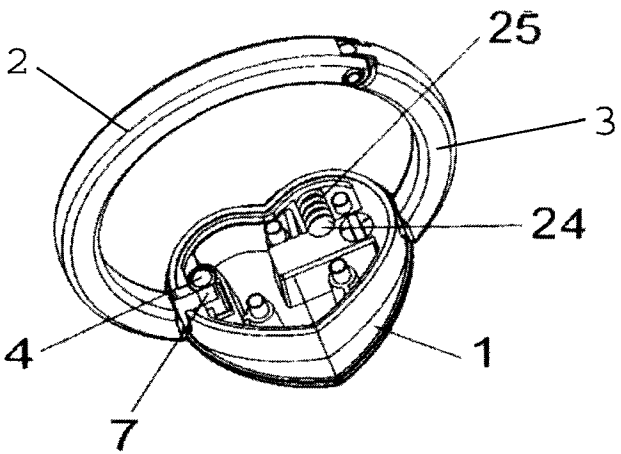

FIG. 7*a* depicts a fifth embodiment of the purse hanger disclosed herein where the second link (2) is in a second position for interlocking with the housing (1) and the first link (3) and the second link (2) together form a ring configuration extending away from the edge of the housing. A locking pin (5) extends from a terminal end of the second link (2). The fifth embodiment further comprises a frictional element (4) in the housing (1). The frictional element (4) is adapted to frictionally engage with the locking pin (5). In this embodiment, the locking pin (5) further comprises an indentation (7) which engages with the frictional element (4) to provide a resistance to the rotation of the locking pin (5). The locking pin (5) further comprises a locking element (6) near a terminal end of the locking pin (5), and wherein the locking cavity (8) comprises a groove (9) being adapted to interlock with the locking element (6). The housing further comprises a ball (24) and a spring (25), wherein the spring (25) urges the ball (24) against the connection pin (10). The connection pin further comprises a depression (26) for engaging with the ball (24) to provide a resistance to the rotation of the connection pin (10). The ball may comprise a metal or metal alloy disclosed herein. In some embodiments, the ball comprises stainless steel.

FIG. 7*b* depicts the fifth embodiment of the purse hanger disclosed herein where the second link (2) is in the second position and the first link (3) and the second link (2) together form a ring configuration extending away from the bottom of the housing.

While the invention has been described with respect to a limited number of embodiments, the specific features of one embodiment should not be attributed to other embodiments of the invention. No single embodiment is representative of all aspects of the invention. In some embodiments, the compositions or methods may include numerous compounds or steps not mentioned herein. In other embodiments, the compositions or methods do not include, or are substantially free of, any compounds or steps not enumerated herein. Variations and modifications from the described embodiments exist. Finally, any number disclosed herein should be construed to mean approximate, regardless of whether the word "about" or "approximately" is used in describing the number. The appended claims intend to cover all those modifications and variations as falling within the scope of the invention.

What is claimed is:

1. A purse hanger comprising:

a) a housing having a bottom surface and a locking cavity, wherein the bottom surface being adapted to rest upon and frictionally engage a flat surface;

b) a first link and a second link pivotally linked to each other;

c) a connection pin extending from a terminal end of the first link, wherein the connection pin is rotatably attached to the housing around an axis;

d) a locking pin extending from a terminal end of the second link; and e) a frictional element in the housing, wherein the frictional element is adapted to frictionally engage with the locking pin to provide a resistance to the rotation of the locking pin, wherein the frictional element comprises a natural rubber, a synthetic rubber or a combination thereof, wherein the housing further comprises a ball and a spring, and wherein the spring urges the ball against the connection pin to provide a resistance to the rotation of the connection pin.

2. The purse hanger of claim 1, wherein the connection pin further comprises a depression for engaging with the ball.

3. The purse hanger of claim 1, wherein the ball comprises a metal or metal alloy.

4. The purse hanger of claim 1, wherein the axis passes through the housing at an angle to the bottom surface and wherein the angle is at least +1 degree or at least −1 degree.

5. The purse hanger of claim 1, wherein the part of the housing next to the terminal end of the first link is thicker than other parts of the housing.

6. The purse hanger of claim 1, wherein the frictional element comprises a polymer or a polymer composition comprising a polymer.

7. The purse hanger of claim 1, wherein the second link is adapted to move between a first position for hanging the purse and a second position for interlocking with the housing.

8. The purse hanger of claim 7, wherein when the second link is in the second position, the first link and the second link together form a ring configuration extending away from the housing.

9. The purse hanger of claim 8, wherein the ring configuration is substantially circular, semi-circular, oval, triangular, square, rectangular, pentagonal, hexagonal, heptagonal, octagonal, nonagonal or decagonal in shape.

10. The purse hanger of claim 1, wherein the locking pin further comprises a locking element near a terminal end of the locking pin, and wherein the locking cavity comprises a groove being adapted to interlock with the locking element.

11. The purse hanger of claim 10, wherein the locking pin generally corresponds to the shape of the locking cavity.

12. The purse hanger of claim 1, wherein the first link rotatably moves between two terminal positions separated by an angle.

13. The purse hanger of claim 12, wherein the angle between the two terminal positions is 90 degree, 180 degree, 270 degree or 360 degree.

14. The purse hanger of claim 1, wherein each of the first link and the second link independently comprises a metal or metal alloy.

15. The purse hanger of claim 1, wherein the housing comprises a metal or metal alloy.

16. The purse hanger of claim 1, wherein the purse hanger further comprises a decorative element mounted on a surface of the housing opposite to the bottom surface, wherein the decorative element comprises one or more precious metals, one or more precious gems or stones, one or more artificial gemstones, one or more plastic ornaments, or a combination thereof.

17. The purse hanger of claim 1 further comprising a third link and/or a fourth link between the first link and the second link, wherein the links are pivotally linked together.

18. The purse hanger of claim 1 further comprising a frictional layer attached to the bottom surface.

* * * * *